US006377174B1

(12) United States Patent
Siegwart et al.

(10) Patent No.: US 6,377,174 B1
(45) Date of Patent: Apr. 23, 2002

(54) INTRUSION DETECTOR HAVING A SABOTAGE SURVEILLANCE DEVICE

(75) Inventors: David Siegwart, Männedorf; Peter Stierli, Uerikon, both of (CH)

(73) Assignee: Siemens Technologies AG, Cerberus Division, Mannedorf (CH)

( * ) Notice: Subject to any disclaimer, the term of this patent is extended or adjusted under 35 U.S.C. 154(b) by 0 days.

(21) Appl. No.: 09/587,812

(22) Filed: Jun. 6, 2000

(51) Int. Cl.[7] ..... G08B 13/00

(52) U.S. Cl. ..... 340/541; 340/522; 340/555; 340/567

(58) Field of Search ..... 340/541, 567, 340/522, 545, 555; 367/94

(56) References Cited

U.S. PATENT DOCUMENTS

| | | | | |
|---|---|---|---|---|
| 4,410,884 A | * | 10/1983 | Heiland | 340/545 |
| 4,710,629 A | * | 12/1987 | Miiller et al. | 250/342 |
| 4,727,522 A | * | 2/1988 | Steiner et al. | 367/94 |
| 4,746,910 A | * | 5/1988 | Pfister et al. | 340/567 |
| 4,752,768 A | | 6/1988 | Steers et al. | 340/567 |
| 5,093,656 A | * | 3/1992 | Dipoala | 340/522 |
| 5,504,473 A | * | 4/1996 | Cecic et al. | 340/541 |
| 5,831,529 A | * | 11/1998 | Pantus | 340/555 |
| 5,942,976 A | | 8/1999 | Wieser et al. | 340/565 |
| 6,127,926 A | * | 10/2000 | Dando | 340/541 |

FOREIGN PATENT DOCUMENTS

| | | |
|---|---|---|
| EP | 0186226 | 7/1986 |
| EP | 0499177 | 8/1992 |
| EP | 0556898 | 8/1993 |
| EP | 0772171 | 5/1997 |

OTHER PUBLICATIONS

Search report for European Patent Application EP 99110848.

* cited by examiner

*Primary Examiner*—Jeffery Hofsass
*Assistant Examiner*—Phung T Nguyen
(74) *Attorney, Agent, or Firm*—BakerBotts LLP

(57) ABSTRACT

An intrusion detector has a housing with an infrared device disposed therein, an infrared sensor, a detector window provided in the housing wall for the passage of infrared radiation from the external space onto the infrared sensor, an element for focusing the infrared radiation incident through the detector window onto the infrared sensor and having a sabotage surveillance device including an infrared transmitter and an infrared receiver. The infrared transmitter and the infrared receiver are disposed inside the housing and the detector window is substantially transparent to radiation emitted by the infrared transmitter. The sabotage surveillance of the detector takes place by measuring the proportion of the radiation reflected onto the infrared receiver from the inside of the detector window and the radiation transmitted onto the infrared receiver from the surrounding space. The detector may also contain an ancillary detector device such as an ultrasonic device with an ultrasonic transmitter and an ultrasonic receiver. The signal of the ultrasonic receiver preferably has two frequency ranges; one range which is typical of movements in the space under surveillance and the other which is typical of sabotage of the detector. A common evaluation circuit is provided for the ultrasonic section and the infrared section.

13 Claims, 2 Drawing Sheets

INTRUSION DETECTOR HAVING A SABOTAGE SURVEILLANCE DEVICE

FIELD OF THE INVENTION

The present invention relates to an intrusion detector and more particularly to an intrusion detection having a housing and an infrared detection portion disposed therein, comprising an infrared sensor, a detector window provided in the housing wall for the passage of infrared radiation from the external space to the infrared sensor, a means for focusing the external infrared radiation transmitted through the detector window onto the infrared sensor, and a sabotage surveillance device including an infrared transmitter and an infrared receiver.

BACKGROUND OF THE INVENTION

Sabotage surveillance devices, which are also referred to as anti-mask devices are described, for example, in EP-A-0 186 226, in EP-A-0 499 177 and in EP-A-0 556 898. These devices serve to detect the two types of detector masking, i.e. detector masking at a certain distance from the detector window, which distance may be only small, and the direct masking of the detector window, for example, by masking the window with a foil or spraying it with an infrared-opaque spray, such as, for example, paint spray. The first type of masking is referred to as remote masking and the second type as spray masking. Remote masking is understood to mean a masking effected at a distance from a few millimeters up to a maximum of about 15 cm.

Changes immediately in front of a detector, such as remote masking, generally affect the reflection of the radiation emitted by the infrared transmitter of the anti-sabotage device from the detector window onto the infrared receiver and cause a change in the radiation received by the infrared receiver. To detect changes in the transmission properties of the detector window, infrared radiation is emitted in the direction of the detector and the radiation passing through the detector window or reflected thereby is measured. To evaluate the signals of the anti-sabotage device, the signals of the infrared receiver are compared with threshold values or reference values or, generally, voltage values that have to be exceeded or not reached and have to be maintained over a certain period of time.

The known sabotage surveillance devices are constructed as single-channel or two-channel systems. In the case of two-channel systems, such as, for example, the device described in EPA-0 186 226, a first infrared transmitter that is disposed in the interior of the detector emits infrared radiation into the surveillance space in front of the detector and a first receiver measures the radiation reflected from the surveillance space. A second infrared transmitter disposed on the outside of the detector emits radiation through the detector window onto a second receiver that measures the incident radiation of the second transmitter. The first transmitter and the first receiver form a channel for surveying sabotage attempts of the remote masking type and the second transmitter and the second receiver form a channel for surveying sabotage attempts of the spray masking type.

In the single-channel system described in EP-A-0 499 177, the sabotage surveillance device contains only one infrared transmitter and only one infrared receiver, the transmitter being disposed on the outside of the detector and the receiver in the interior. The transmitter transmits infrared radiation into the surveillance space in front of the detector and through the detector window onto the receiver. A similar single-channel system is described in EP-A-0 556 898.

Common to all known sabotage surveillance devices, regardless of whether they are designed as a single-channel system or as a two-channel system, is the fact that an element of the device is disposed on the outside of the detector. This arrangement influences, to a certain extent, the design of the detector housing because a protruding section for receiving the infrared transmitter must be present on the housing opposite the detector window which substantially influences the external appearance of the detector.

In the anti-masking device described in EP-A-0 772 171, an optical diffraction grating structure is mounted on the outside of the detector window that focuses light emitted by an infrared transmitter onto the optical receiver. In the event of sabotage as a result of spraying the detector window, the focusing action of the optical diffraction grating structure is affected so as to reduce the light intensity focused onto the infrared detector. Although the infrared transmitter is disposed in the interior of the detector in this device, the optical diffraction grating structure is located externally. An important draw back of this design is that particles contained in the air of the space under surveillance, for example smoke particles or soot particles or even grease particles, become deposited on the grating structure, as well as the detector window, which over time discolors and even affects the infrared-radiation transmission properties. This structure may constitute a technical disadvantage which impairs the serviceability of the detector. The potential discoloration of the diffraction grating on the detector window may also constitute an aesthetic disadvantage. In addition, the optical diffraction grating structure is not suitable for detecting remote masking.

An object of the present invention is thus to provide an intrusion detector having a sabotage surveillance device that detects both types of sabotage, namely remote masking and spray masking. Preferably, such sabotage can be detected in the so-called real-time mode. Real-time mode is understood as meaning a method in which only sufficiently large and sufficiently stable changes trigger a sabotage alarm that is automatically withdrawn if the signals return to the normal state. Although this mode responds more slowly than the second known method, the so-called proximity latch mode, it has the advantage of automatic alarm cancellation. In addition, the intrusion detector upgrades the sabotage surveillance device that neither restricts the creative range for the design of the detector housing nor results in impairments of the functional reliability of the external appearance of a detector equipped with such a device An improvement realized by the present invention is that the infrared transmitter and the infrared receiver are both disposed within the housing, with the detector window being substantially transparent to radiation emitted by the infrared transmitter. The present arrangement obviates the need for an externally mounted diffraction grating on the detector window. Sabotage of the detector is kept under surveillance by measuring the proportion of the said radiation reflected onto the infrared receiver from the inside surface of the detector window and that reflected from the surrounding space.

The arrangement of transmitter and receiver inside of the detector window affords not only aesthetic aspects in the design of the detector housing, but also lessens the risk of excessive particle deposits on the detector window which tends to accumulate in external defraction gratings. And perhaps even more important is the fact that the detector has a sabotage surveillance device is not detectable from the external appearance of the device.

A further aspect of the invention is that the infrared receiver of the sabotage detector device is capable of compensating for extraneous light passing through the detector window.

Yet another aspect of the present invention is that the means for focusing the infrared radiation from the external space which passes through the detector window is formed by a base layer of dark material and a mirror having a reflection layer applied to the base layer. The reflection layer is transparent to interfering radiation below the typical wavelength range of human thermal radiation and yet highly capable of reflecting radiation within the wavelength range of human thermal radiation. In this content, "dark material" means a material that absorbs well below a wavelength of about 4 $\mu$m. The reflection layer is substantially transparent in the visible range and transmits infrared radiation of shorter wavelengths, preferably below 4–7 $\mu$m so that the latter can reach the dark base layer, where it is absorbed. Furthermore, the layer of dark material has the effect that as little interfering light as possible falls on the sensor and on the infrared receiver, which is important in order for the detector to be able to detect both types of sabotage, remote masking and spray masking, in the real-time mode.

In a preferred embodiment of the intrusion detector according to the present invention the detector includes an ancillary device for detecting an intruder comprising an additional transmitter and an additional receiver. The signal of the additional receiver has two frequency ranges, one of which is typical of movements in the space under surveillance and the other is typical of a masking affect on the detector. A common evaluation circuit is provided for the ancillary detection means and the infrared detector. The ancillary device is preferably an ultrasonic device having an ultrasonic transmitter and an ultrasonic receiver or a microwave section having a microwave transmitter and a microwave receiver.

In a further preferred embodiment of the intrusion detector according to the invention the evaluation circuit has a passive infrared ("PIR") channel connected downstream of the infrared sensor, an anti-mask channel connected downstream of the infrared receiver and an ultrasound ("US") channel that is connected downstream of the second receiver and a US anti-mask channel. The evaluation circuit may also have a combining stage connected to the outputs of the aforesaid channels for the combined evaluation of the signals of the channels.

The invention is explained in greater detail below by reference to an exemplary embodiment shown in the drawings.

DESCRIPTION OF PREFERRED EMBODIMENTS

Figure 1:
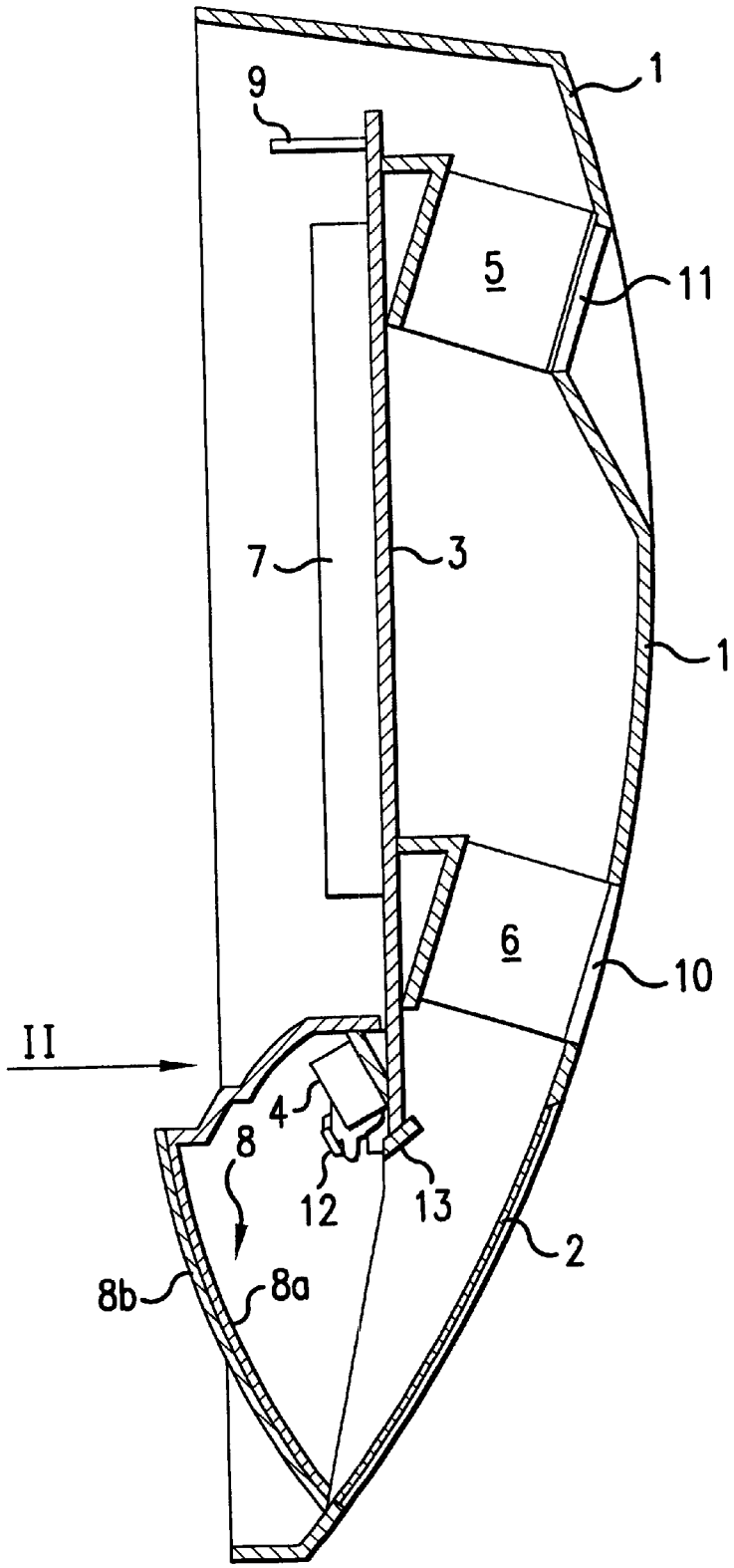
FIG. 1 shows a longitudinal section through an intrusion detector according to the invention.
Figure 2:
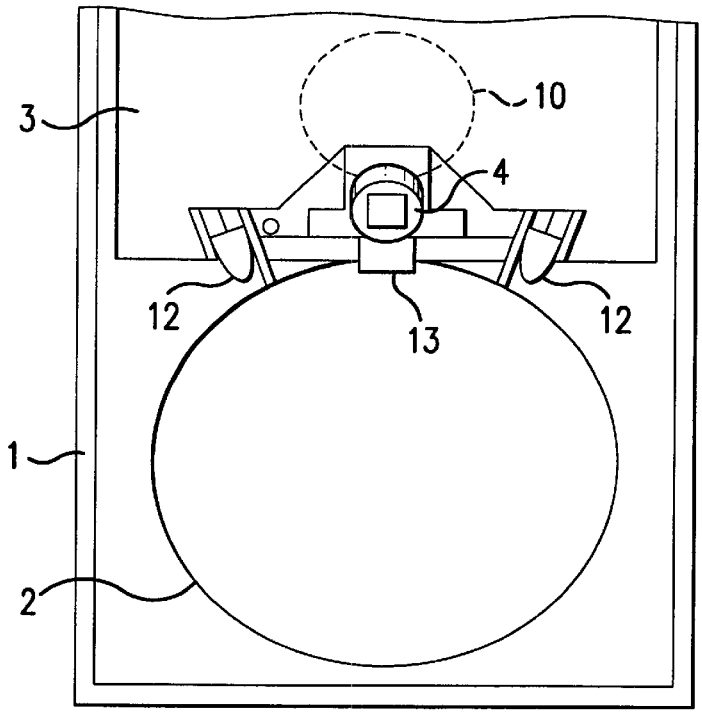
FIG. 2 shows a partial view in the direction of the arrow II of FIG. 1.

FIG. 1 shows a longitudinal section through an intrusion detector according to the invention in the direction perpendicular to its rear wall or base, the base being removed, and FIG. 2 shows a partial view from behind, with the mirror for focusing the external infrared radiation being removed from the detector in this view. The intrusion detector shown is a dual detector that comprises the combination of a passive infrared detector and an ultrasonic detector connected with the latter via an intelligent combination circuit. The infrared section responds to the body radiation of a human being in the infrared spectral range and the ultrasonic section responds to the frequency shift, due to the Doppler effect, in the ultrasound reflected by a moving intruder. As a result of combining the two principles, the intrusion of an individual into the protected region can be detected with greater reliability and selectivity than if only one of the two methods of detection would to be used. In this way, a false alarm signal emission can be avoided with greater reliability.

Since the two detectors are connected to one another by a circuit which requires condition signals from both detectors to generate an alarm output, the intrusion detector can be compromised by sabotaging only one of the detectors. Such sabotage generally takes place on the infrared detector in the form of remote masking or spray masking. To disable the ultrasonic section, the entire detector would have to be masked and this would be immediately detectable. The sabotage surveillance device used in the intrusion detector described below likewise serves to detect sabotage at the infrared detector and can therefore be used not only in conjunction with dual detectors, but also on single detector, passive infrared detector devices.

The intrusion detector according to the invention comprises a two-section housing having a base (not shown) and a cover 1. A detector window 2 is provided in the cover 1 for the passage of infrared radiation falling on the detector from the space under surveillance into the interior of the detector. A board 3 is disposed in the interior of the detector and on which, inter alia, an infrared sensor 4, an ultrasonic transmitter 5, an ultrasonic receiver 6 and an evaluation circuit 7 are disposed. A mirror 8 is likewise disposed in the interior of the detector, for focusing the external infrared radiation which passes through the detector window 2 onto the infrared sensor 4. Disposed at the upper end of the board 3 is a pin element 9 of an electrical plug connector the socket element for which is located in the housing base. When the housing is closed, the pin element 9 is plugged into the socket element, thereby making the electrical contact to the current supply and any data lines.

The detector window 2 is, for example, made of polyethylene or polypropylene and is transparent to radiation in the wavelength range from about 5 to 15 $\mu$m and also in the range around approximately 0.9 $\mu$m. The mirror 8 is preferably designed so that it absorbs radiation in the near infrared range and reflects body radiation. Particularly well suited for this purpose are mirrors having a base layer 8*a* of dark material and a reflection layer 8*b* that is applied thereto and that is transparent to interfering radiation below the aforesaid wavelength range and is capable of reflecting radiation within the wavelength range. In regard to the shape of the mirror, reference is made to EP-A-0 303 913 and in regard to the mirror construction, reference is made to EP-A-0 707 294 both of which are hereby incorporated by reference in their entirety. The detector window 2 may be designed as a Fresnel lens which directly focuses the external infrared radiation directly onto the infrared sensor 4 without the need for mirror 8.

An ultrasonic transmitter 5 is preferably included which radiates ultrasound having a frequency of over 20 kHz through an aperture 10 in the housing cover 1 into the space under surveillance in front of the detector. An ultrasonic receiver 6 picks up the ultrasound reflected from the space under surveillance through a window 11 in the housing cover 1 and feeds a corresponding signal to the evaluation circuit 7. While positionally fixed objects reflect only ultrasound having the transmission frequency, a moving object causes a frequency shift in accordance with the Doppler effect. The evaluation circuit 7 triggers an alarm signal if a detected frequency shift corresponds to the values typical for a moving human being and if the infrared sensor 4 receives an infrared radiation typical of a human being at the same time.

The intrusion detector shown is equipped with an anti-masking device for detecting activities or optical changes immediately in front of the detector, i.e., remote masking, and changes in the optical properties of the detector window 2, in particular when it is sprayed with a masking substance, i.e., spray masking.

Masking serves to disable the detector in such a way that no infrared radiation can reach the infrared sensor, hence individuals are no longer detected and thus can move freely within the space under surveillance. Masking or sabotage is generally carried out when the detector is set to a standby mode and individuals located in the space under surveillance do not trigger an alarm.

The sabotage surveillance device of the present invention is to be capable of detecting such masking automatically and, preferably, at the time of masking or at the latest when the detector or system is set. There are various strategies in this regard, but the situation at present is, as a rule, at least in the case of detectors connected to a center, that the detectors are always switched on and deliver alarm signals to the center even when they are in the standby mode, but the center suppresses said signals in the standby mode. If the detector is always switched on, it can detect sabotage attempts without time delay and signal them to the center.

The sabotage surveillance device is so designed that both types of masking methods are reliably detected by a single channel. As is evident, in particular from FIG. 2, infrared transmitters 12 are disposed in each case at the lower end of the board 3, which is in the region of the upper periphery of the detector window 2, on both sides of the infrared sensor 4 and symmetrically with respect to the latter. The infrared transmitters 12, which are each formed by an infrared LED (so-called IREDs), which emit radiation in the near infrared range of about 0.9 $\mu$m are mounted on the board 3 in such a way that they are aligned with the center of the detector window 2. An infrared receiver 13 is provided on the board 3 in the center between the two infrared transmitters 12 and below the infrared sensor 4. The infrared receiver 13 is disposed so as to be inclined with respect to the board 3 at a certain angle. The angle of inclination is chosen so that a depending on the optical properties of the detector window. A certain portion of the radiation emitted by the infrared transmitters 12 is reflected onto the infrared receiver 13. The infrared receiver is preferably formed by a "pn" diode.

In the evaluation circuit 7, the signal of the infrared receiver 13 is compared with an alarm threshold and, preferably, also with a plurality of pre-alarm thresholds. In the case of an evaluation of the infrared receiver in output with the aid of fuzzy logic in the evaluation circuit, the signal is investigated according to the appropriate fuzzy logic rules. If threshold values or reference values are mentioned below, this also means analogously fuzzy rules. The evaluation generally takes place in the real-time mode, which responds to time-stable values, that is to say fairly long-persisting changes of the respective threshold values or reference values. A sabotage alarm is triggered only if the changed values persist for a period of time. In addition, the sabotage alarm is automatically reset as soon as the detector returns to its normal state i.e., threshold or reference values. The resetting operation does not require any intervention by an operating individual.

In the normal operating state of the detector the infrared receiver 13 always receives a certain proportion of the radiation emitted by the infrared transmitters 12, of which a portion passes outwards through the detector window 2, and another portion is reflected by the detector window 2 onto the infrared receiver 13. Provided the signal of the infrared receiver 13 is within a certain bandwidth, it can reliably be assumed that the detector is not masked.

Since the pn diode forming the infrared receiver 13 has a non-linear characteristic and since, in addition, the detector window 2 has to be transparent to a certain degree because of the arrangement of the sabotage surveillance device in the interior of the detector, the extraneous light reaching the infrared receiver 13 has to be compensated for. For this purpose, the incident extraneous light is measured and the signal of the infrared receiver 13 corrected accordingly.

A further correction is necessary as a result of the temperature dependence of the optical output of the infrared transmitter 12. This correction is made in that, in the event of temperature changes, either the electrical current through the infrared transmitter 12 is modified via the characteristic in such a way that the intensity of the specified infrared radiation remains constant, or the signal component originating from the infrared transmitter 12 is multiplied in the infrared receiver 13 by a correction factor that compensates for the temperature-dependent optical output of the infrared transmitter 12.

If the signal of the infrared receiver 13 drops below a specified minimum value, this means that the radiation received by the infrared receiver 13 has dropped and that is an indication of a spray masking of the detector window 2 with a dark color spray which reflects the radiation of the infrared transmitter 12 less strongly in the sprayed state than in the normal state. If the signal of the infrared receiver exceeds a specified maximum value, this means that either a larger proportion of the radiation emitted by the infrared transmitter 12 is being reflected from the external space (remote masking) or that the detector window is reflecting more strongly than in the normal state (spray masking with a bright paint spray). With the sabotage surveillance device described, which is disposed completely behind the detector window 2 in the interior of the detector, it is therefore possible to detect both masking methods with a single channel using the two infrared transmitters 12 and the infrared receiver 13 without additional aids, such as, for example, reflecting vanes or additional reflecting surfaces or infrared diodes disposed on the outside of the detector housing being necessary.

Figure 3:
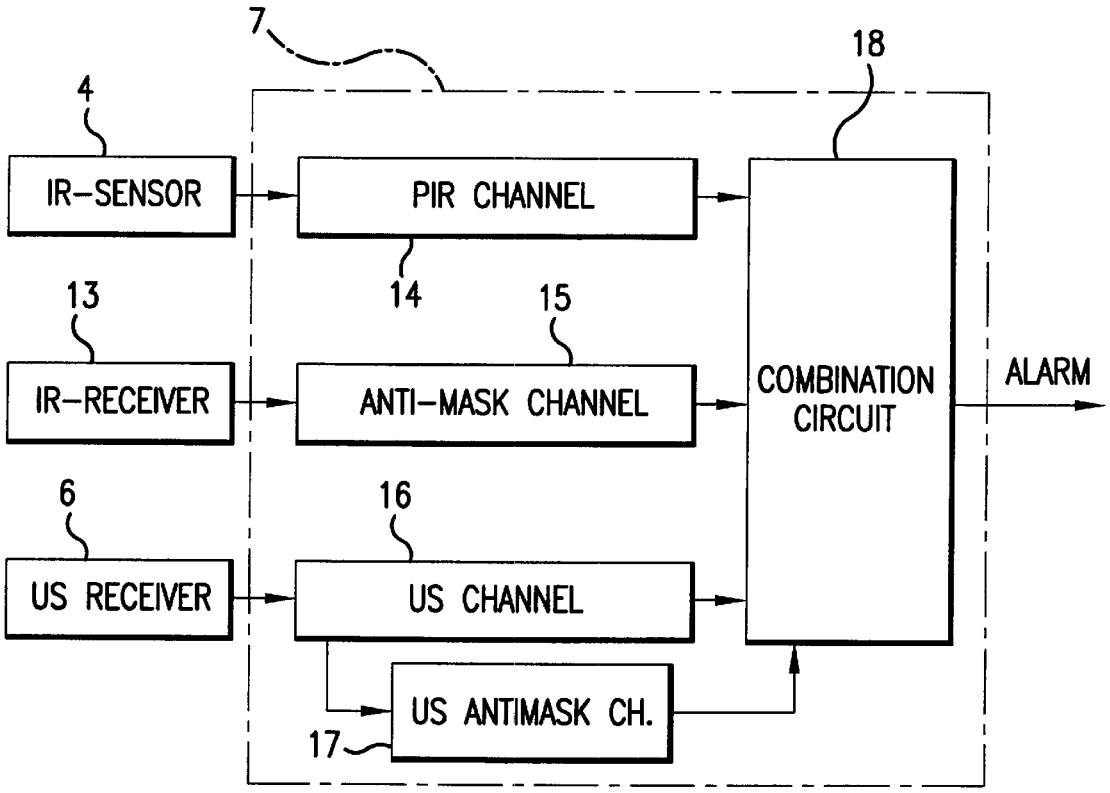
FIG. 3 shows a block circuit diagram of the detector of FIG. 1.

In accordance with FIG. 3, the evaluation circuit 7 (FIG. 1) contains a PIR channel 14 connected to the infrared sensor 4, an anti-masking channel 15 connected to the infrared receiver 13, a US channel 16 that is connected to the ultrasonic receiver 6 and has a US anti-masking channel 17, and a combining stage 18. The outputs of the four channels mentioned are fed to the combining stage 18, in which a combined evaluation of the signals of the individual channels is carried out. The result of said combined evaluation forms the decision basis for the emission of an alarm by the detector, whether the latter is an intrusion alarm or a masking alarm.

The combined evaluation of the PIR channel 14 and of the US channel 16 essentially consists in an intrusion alarm being emitted by the detector if the signal in the US channel 16 exhibits a predetermined frequency shift, dependent on the speed of movement of an object, compared with the transmission frequency and, at the same time the PIR channel 14 receives infrared radiation typical of the presence of a human being. The evaluated Doppler frequency range is 25.6 kHz±500 Hz since, in the case of movements that are not extremely fast, which can be assumed in the case of an intruder, a signal is generated in this frequency range.

Between the anti-masking channel 15 and the US channel 16 there is only a relatively loose combination which is such that both of these channels or either one can detect certain types of masking so that the two channels compliment one another in a very effective manner. In the anti-masking channel, the signal of the infrared receiver 13 is observed in terms of direct current or, in other words, deviations of the signal from its quiescent value are investigated. That is necessary for the real-time mode because it is only in this way that the return of the detector to its normal operating state, that is to say the removal of the masking, can be detected. Since the processing of the signal must be digital, an analog to digital (A/D) conversion of the signal takes place in the infrared receiver 13 by means of a high-resolution analog to digital (A/D) converter. The large dynamic range of the analog to digital (A/D) converter is necessary because the latter must cover the quiescent range of the signal and detect very small deviations from the latter, but the quiescent value is subject to severe variations because of the manufacturing tolerances and the variation in the electro optical efficiency of the optical components.

In the US anti-masking channel 17, sabotage surveillance takes place for the ultrasonic device. For this purpose, the ultrasonic transmitter 5 emits a short ultrasonic pulse as a result of a brief switching-on/off or switching-off-on, which produces, inter alia, a wide frequency spectrum also between 24 and 25 kHz. The signal in this frequency range is evaluated for amplitude and time variation. In this connection, the parameters mentioned are investigated for deviations from mean values or previous measurement results that are typical for changes in the space in front of the detector, in particular for those deviations that are characteristic of the application of a screening or masking in front of the detector. Since no evaluation of the Doppler frequency range occurs in this case, movements and air turbulence cannot disturb the anti-masking function.

The ultrasonic device itself is therefore protected against sabotage. In addition, it compliments the infrared section in detecting remote masking with materials that are poorly detected by the infrared device, for example, objects that are transparent in the infrared range or black objects. Alternatively, the anti-masking channel 15 detects bright, acoustically soft materials very well and therefore is complimentary to the anti-masking function of the ultrasonic device. If the infrared device and the ultrasonic device were more strongly interlinked with one another, for example by arranging ultrasonic transmitter 5 and ultrasonic receiver 6 on different sides of the detector window 2 (left and right, top and bottom, or diagonally opposite), the signals of channels 15 and 16 could be more strongly combined.

The ultrasonic device comprising the ultrasonic transmitter 5 and the ultrasonic receiver 6 can also be replaced by a microwave device including a microwave transmitter and a microwave receiver, in which case certain circuit modifications familiar to the person skilled in the art would be necessary.

What is claimed is:

1. An intrusion detector having a housing, an infrared sensor, a detector window formed in the housing for the passage of infrared radiation from an external space to the infrared sensor, an element for focusing infrared radiation onto the infrared sensor and a sabotage surveillance device comprising:

an infrared transmitter;

and an infrared receiver, the infrared transmitter and the infrared receiver being located inside the housing and the infrared transmitter is directed toward the window such that at least a portion of infrared radiation transmitted by said transmitter is reflected by said window onto said receiver.

2. The intrusion detector according to claim 1, wherein the sabotage of the detector is determined by measuring the amount of radiation reflected by the detector window onto the infrared receiver.

3. The intrusion detector according to claim 1, wherein the infrared receiver is capable of compensating for extraneous light coming from the external space.

4. An intrusion detector according to claim 1, is capable of compensating for the temperature dependence of the optical output of the infrared transmitter.

5. An intrusion detector according to claim 1, wherein the element for focusing includes a base layer of dark material and a reflecting layer applied to the base layer, the reflecting layer being substantially transparent to interfering radiation substantially below the wavelength range of human thermal radiation and capable of reflecting radiation substantially within the wavelength range of human thermal radiation.

6. An intrusion detector according to claim 1, wherein the sabotage surveillance device has two infrared transmitters angularly arranged relative to the detector window, and wherein the infrared receiver is disposed between the two infrared transmitters.

7. An intrusion detector according to claim 1, further comprising an ancillary detector device comprising an ancillary transmitter and an ancillary receiver and wherein the signal of the ancillary receiver has two detection ranges, one of which is typical of movements in the space under surveillance and the other is typical of a masking of the detector, and further comprising a common evaluation circuit for the respective detector devices.

8. An intrusion detector according to claim 7, wherein the ancillary transmitter and the ancillary receiver of the ancillary detector device are proximate to the periphery of the detector window.

9. An intrusion detector according to claim 7, wherein the evaluation circuit has a PIR channel connected downstream of the infrared sensor, an anti-mask channel connected downstream of the infrared receiver and a US channel having a US anti-mask channel that is connected downstream of the additional receiver and the evaluation circuit having a combining stage connected to said channels for the combined evaluation of the signals of said channels.

10. An intrusion detector according to claim 9, wherein for combined evaluation, the ancillary detector device compliments the sabotage surveillance device in the detection of materials that are poorly detected by infrared radiation and the sabotage surveillance device compliments the ancillary detector device in the detection of materials that are poorly detectable by the ancillary detector.

11. An intrusion detector according to claim 7, wherein the ancillary detector is an ultrasonic device comprising an ultrasonic transmitter and an ultrasonic receiver.

12. An intrusion detector according to claim 7, wherein the ancillary detector is a microwave device comprising a microwave transmitter and a microwave receiver.

13. An intrusion detector according to claim 9, wherein the anti-masking channel contains a high-resolution A/D converter for the digitization of the signal of the infrared receiver.

* * * * *